US010932578B1

(12) United States Patent
Lin

(10) Patent No.: US 10,932,578 B1
(45) Date of Patent: Mar. 2, 2021

(54) ARMREST FRAME FOR A FOLDABLE SEAT WITH A CUP HOLDING DEVICE

(71) Applicant: Spec Seats Technologies Inc., Taoyuan (TW)

(72) Inventor: Mei Chuen Lin, Taoyuan (TW)

(73) Assignee: Spec Seats Technologies Inc., Taoyuan (TW)

( * ) Notice: Subject to any disclaimer, the term of this patent is extended or adjusted under 35 U.S.C. 154(b) by 0 days.

(21) Appl. No.: 16/703,581

(22) Filed: Dec. 4, 2019

(51) Int. Cl.
*A47C 7/62* (2006.01)
*A47C 4/28* (2006.01)

(52) U.S. Cl.
CPC ..... *A47C 7/624* (2018.08); *A47C 4/28* (2013.01)

(58) Field of Classification Search
CPC ..... A47C 7/624; A47C 7/62; A47C 7/622; A47C 4/28; A47C 4/32; A47C 4/42
USPC ..... 297/55, 56
See application file for complete search history.

(56) References Cited

U.S. PATENT DOCUMENTS 5,421,638 A * 6/1995 Ayotte ..... A47C 7/624 297/188.04
5,573,301 A * 11/1996 Scott ..... A47C 7/68 297/173
5,865,124 A * 2/1999 Wroe ..... A47C 7/70 108/26
7,226,126 B1 * 6/2007 Spanovich ..... A47C 7/62 297/184.16
7,533,931 B1 * 5/2009 Bryant, Sr. ..... A47C 7/62 297/188.08
2015/0289494 A1 * 10/2015 Davis ..... A47C 7/62 43/55
2018/0353357 A1 * 12/2018 Lane ..... A47C 7/62
2019/0118908 A1 * 4/2019 Hernandez ..... A45B 11/00

* cited by examiner

*Primary Examiner* — Mark R Wendell
(74) *Attorney, Agent, or Firm* — Wang Law Firm, Inc.

(57) ABSTRACT

A cup holding device for a foldable seat includes a connecting part and a cup holder. The connecting part is provided on an armrest frame or a front leg frame of a foldable seat, and is located below a seat portion of the foldable seat. The cup holder is mounted on the connecting part, and has a receiving cavity adapted to receive the placement of a container. By placing the connecting part and the cup holder below the seat portion of the foldable seat, the present invention can make use of the space at the bottom of the foldable seat and prevent a drinking container from being accidentally hit by a person's swinging arm causing its tipping over.

3 Claims, 11 Drawing Sheets

ARMREST FRAME FOR A FOLDABLE SEAT WITH A CUP HOLDING DEVICE

BACKGROUND OF THE INVENTION

1. Field of the Invention

The present invention relates to cup holders, and more particularly to a cup holding device that can be easily mounted on a foldable seat.

2. The Prior Arts

A foldable seat usually has a structure that allows it folding into a smaller volume for convenient storage and transport, and may be suitable for use during indoor and outdoor events.

A conventional foldable seat includes a front leg frame having an arcuate shape, a backrest, a seat portion and a rear leg frame. The front leg frame can have two sides respectively connected pivotally to the seat portion and the rear leg frame. The backrest is provided in the region of the arcuate shape of the front leg frame. With the front leg frame pivotally connected to the seat portion and the rear leg frame, the seat portion and the rear leg frame can be rotated and folded for storage.

When an individual sits on the foldable seat for watching a tournament, a conference, or a movie projection, the individual may bring a drink if the watching time is relatively longer. Accordingly, the conventional foldable seat may have a cup holder for placement of the drinking container. The cup holder is usually formed integrally with an armrest of the foldable seat at a front end thereof in front of the elbow for facilitating access.

Because the conventional placement of the cup holder is easily accessed for use, it may happen that a drinking container disposed in the cup holder is accidentally hit by a person's swinging arm and consequently tips over.

SUMMARY OF THE INVENTION

A main objective of the present invention is to provide a cup holding device for a foldable seat that can be conveniently used and prevent a drinking container from being accidentally hit by a person's swinging arm.

Another objective of the present invention is to provide a cup holding device for a foldable seat that can make use of a space at a bottom of the foldable seat for placement of a drinking container.

In order to achieve the foregoing objectives, the present invention provides a cup holding device for a foldable seat that includes a connecting part and a cup holder.

The connecting part is provided on an armrest frame of a foldable seat, and is located below a seat portion of the foldable seat. The cup holder is mounted on the connecting part, and has a receiving cavity adapted to receive the placement of a container.

According to an embodiment of the present invention, the armrest frame includes a support frame portion and an armrest pad, the armrest pad being disposed at a top of the support frame portion, and the connecting part being disposed at a lower end of the support frame portion.

According to an embodiment of the present invention, the armrest frame further includes at least one first joining portion and at least one second joining portion, the first joining portion being provided on one side of the support frame portion, the second joining portion being provided on the other side of the support frame portion, the first joining portion being adapted to assemble with a right side of a front leg frame of the foldable seat, and the second joining portion being adapted to assemble with a left side of the front leg frame of the foldable seat.

According to another embodiment of the present invention, a cup holding device for a foldable seat described herein includes a connecting part and a cup holder.

The connecting part is provided on a front leg frame of a foldable seat, and is located below a seat portion of the foldable seat. The cup holder is mounted on the connecting part, and has a receiving cavity adapted to receive the placement of a container.

According to another embodiment of the present invention, the connecting part includes at least one connecting hole, and the cup holder further has a holding portion, a connecting portion, a connecting slot and at least one fastening hole, the holding portion being provided at one end of the connecting portion, the receiving cavity being opened on the holding portion, the connecting slot being provided at the other end of the connecting portion, the fastening hole being provided at a side of the connecting portion, the fastening hole communicating with the connecting slot and extending through the connecting portion, the connecting part being inserted into the connecting slot, and at least one fastener being engaged through the fastening hole and the connecting hole.

A bottom of the holding portion has at least one through-hole communicating with the receiving cavity.

Preferably, an opening of the connecting slot has a chamfer.

By placing the connecting part and the cup holder below the seat portion of the foldable seat, the present invention can make use of the space at the bottom of the foldable seat and prevent a drinking container from being accidentally hit by a person's swinging arm causing its tipping over.

DETAILED DESCRIPTION OF THE PREFERRED EMBODIMENT

Figure 1:
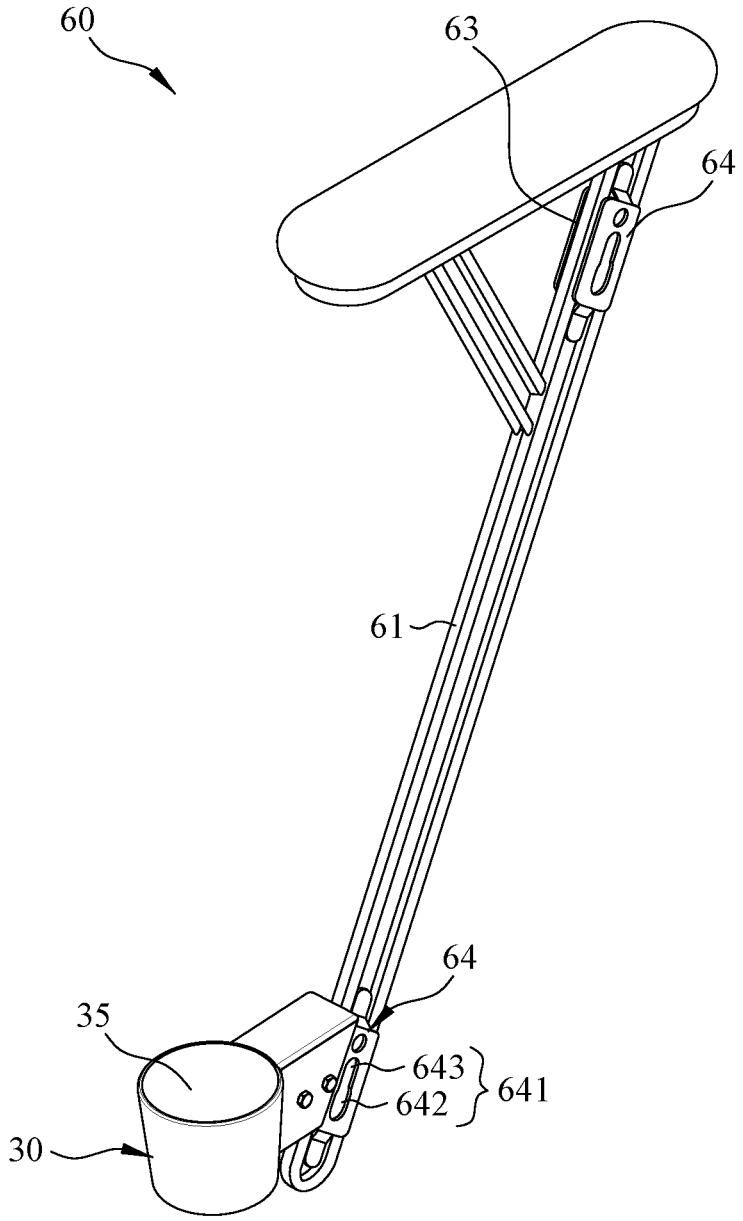
FIG. 1 is a perspective view showing a cup holding device for a foldable seat according to a first embodiment of the present invention.
Figure 2:
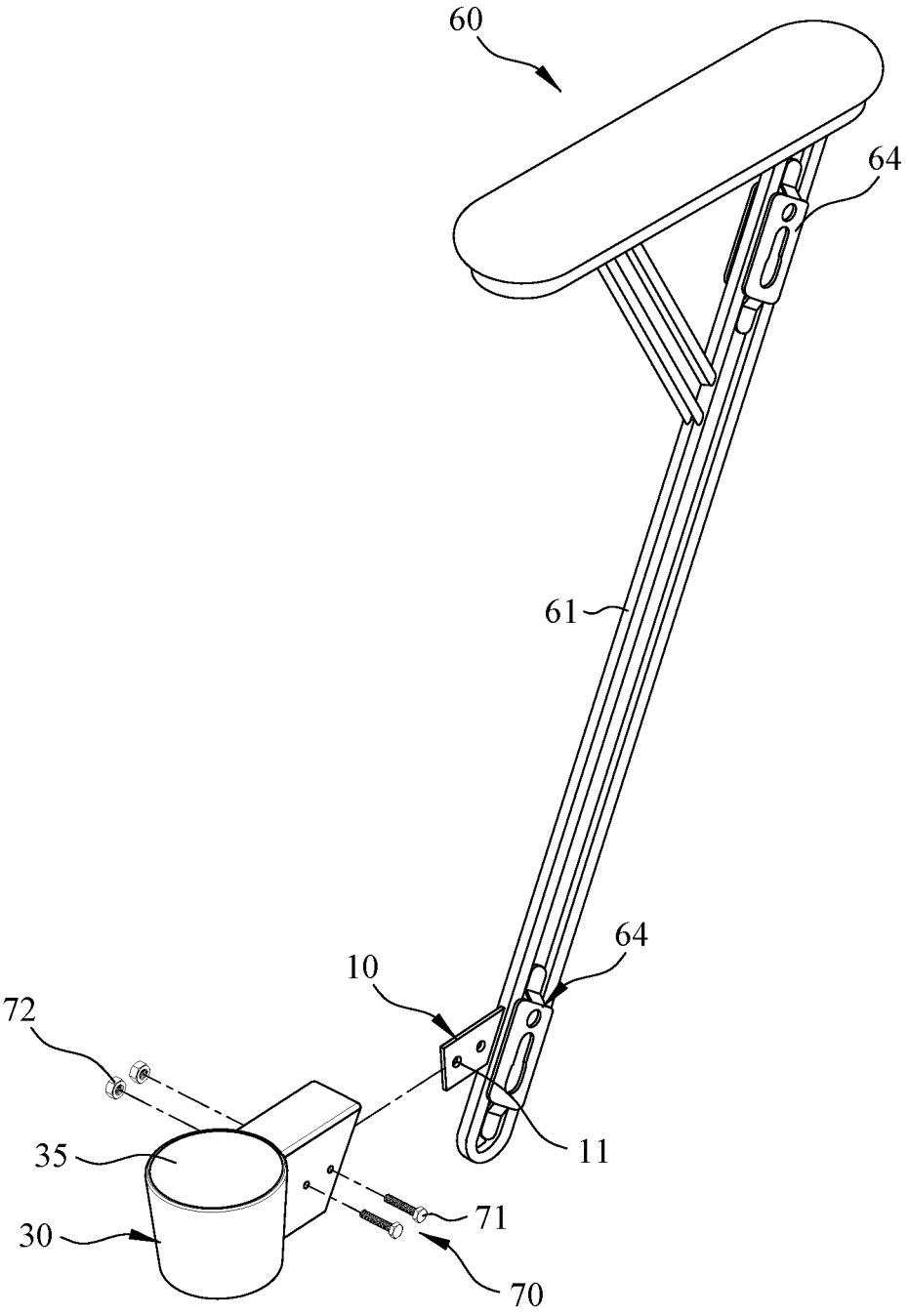
FIG. 2 is an exploded view of the cup holding device for a foldable seat according to the first embodiment of the present invention.
Figure 3:
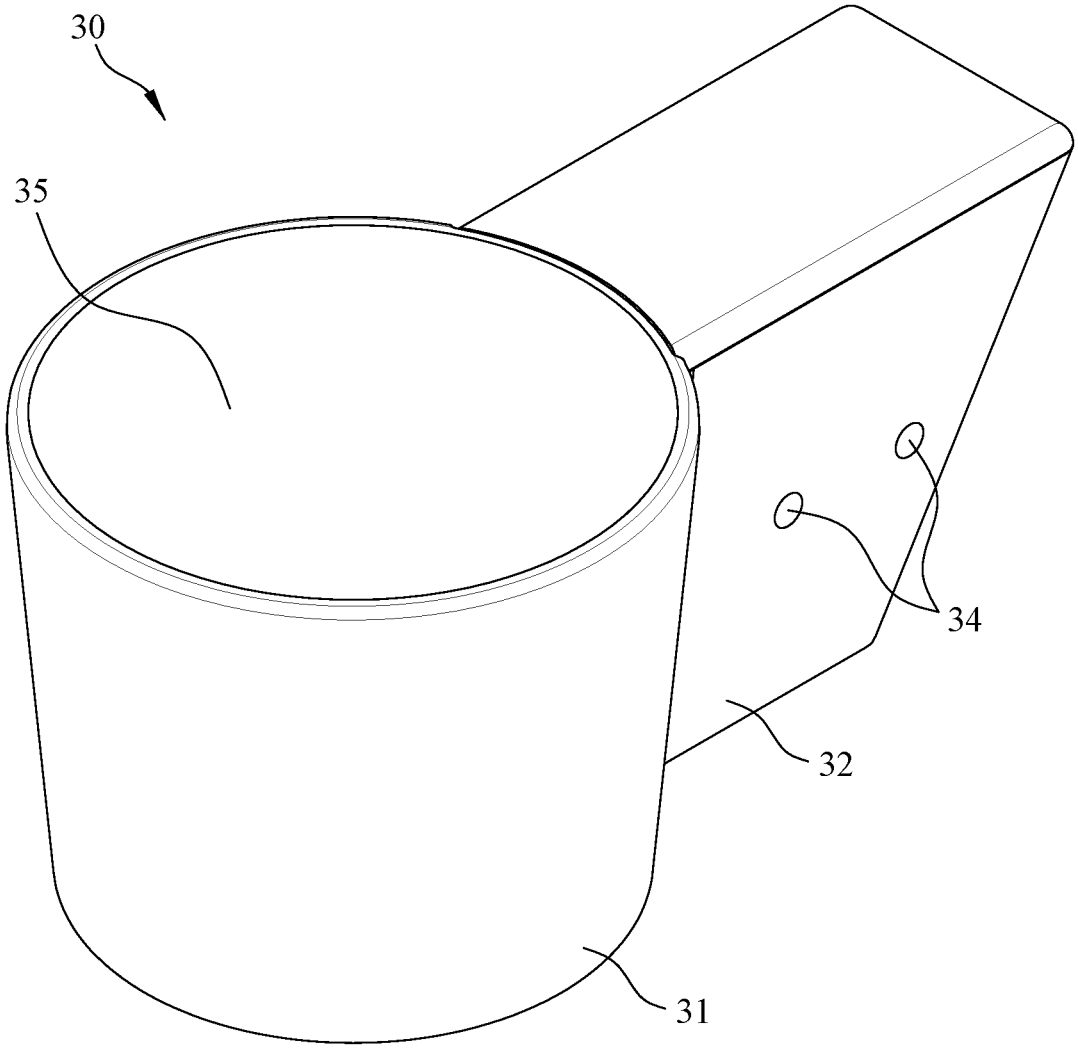
FIG. 3 is a perspective view showing a cup holder of the cup holding device for a foldable seat according to the first embodiment of the present invention.
Figure 4:
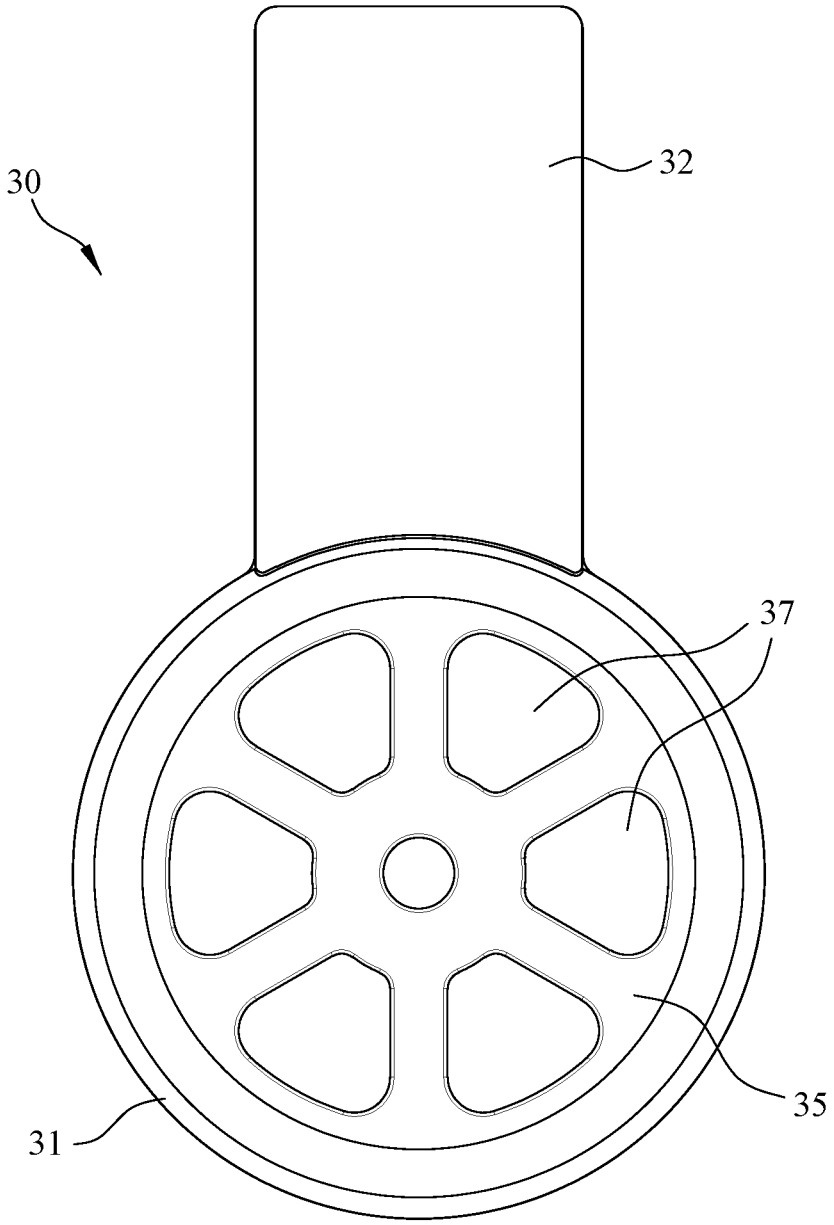
FIG. 4 is a top view of the cup holder of the cup holding device for a foldable seat according to the first embodiment of the present invention.
Figure 5:
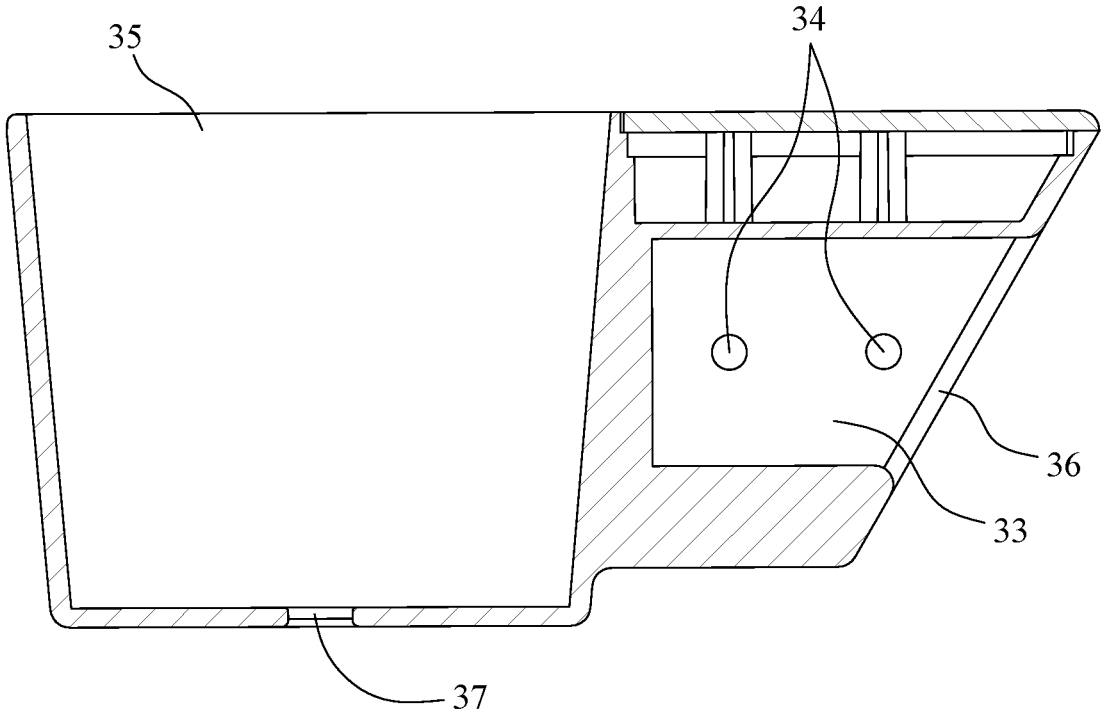
FIG. 5 is a cross-sectional view of the cup holder of the cup holding device for a foldable seat according to the first embodiment of the present invention.
Figure 6:
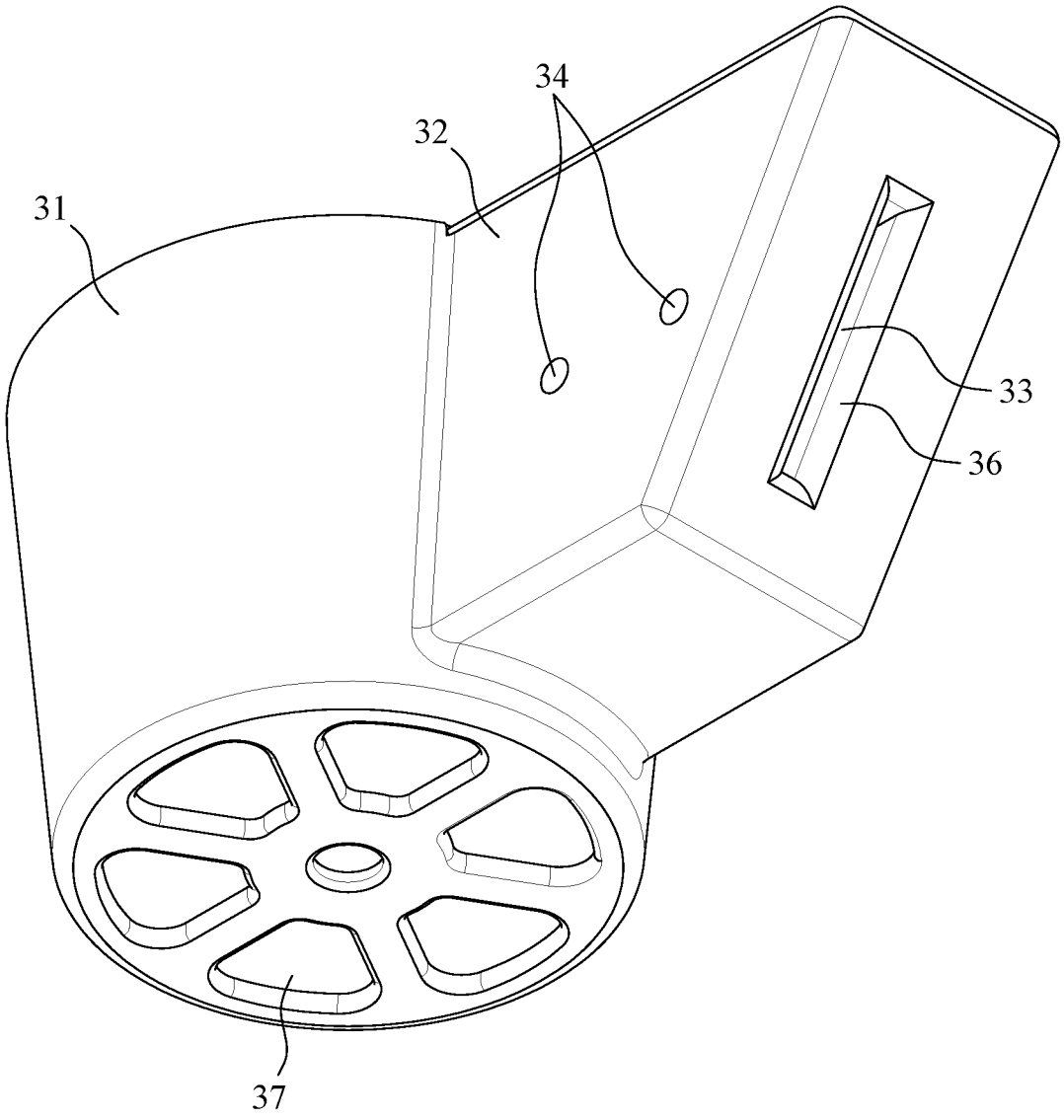
FIG. 6 is a rear perspective view of the cup holder of the cup holding device for a foldable seat according to the first embodiment of the present invention.

FIGS. 1 and 2 are respectively a perspective view and an exploded view of a cup holding device for a foldable seat according to a first embodiment. As shown in FIGS. 1 and 2, a first embodiment of the present invention provides a cup holding device for a foldable seat that includes a connecting part 10 and a cup holder 30.

The connecting part 10 is placed at an end of an armrest frame 60 of a foldable seat 50 (shown in FIG. 7), and includes at least one connecting hole 11. In the first embodiment of the present invention, the connecting part 10 is a flat piece having at least one connecting hole 11.

The cup holder 30 is disposed on the connecting part 10 and has a receiving cavity 35. The receiving cavity 35 can be used for placement of a container 80 (shown in FIG. 9). FIGS. 3, 4, 5 and 6 are respectively perspective, top and cross-sectional views showing the cup holder 30 of the cup holding device for a foldable seat according to a first embodiment of the present invention. As shown in FIGS. 3-6, the cup holder 30 includes a holding portion 31, a connecting portion 32, a connecting slot 33 and at least one fastening hole 34. The holding portion 31 is provided at one end of the connecting portion 32, and the receiving cavity 35 is opened on the holding portion 31. Preferably, the receiving cavity 35 is a cylindrical cavity adapted to receive the placement of various containers 80 (shown in FIG. 9) available on the market, such as drinking cups, thermos bottles, PET bottles and the likes.

In a first embodiment of the present invention, a bottom of the holding portion 31 has at least one through-hole 37 communicating with the receiving cavity 35. When a user places a container 80 (shown in FIG. 9) containing a cold drinking liquid in the receiving cavity 35, droplets of water on an outer surface of the container 80 would be prevented from accumulating at the bottom of the receiving cavity 35. According to the present invention, the cup holder 30 is formed as a single body, and can be fabricated and machined a convenient way.

The connecting slot 33 is provided at the other end of the connecting portion 32 for insertion of the connecting part 10. At least one fastening hole 34 is provided at a side of the connecting portion 32, the fastening hole 34 communicating with the connecting slot 33 and extending through the connecting portion 32. Preferably, an opening of the connecting slot 33 has a chamfer 36 for facilitating insertion of the connecting part 10 into the connecting slot 33 during assembly.

When the connecting part 10 is fully inserted into the connecting slot 33, the connecting hole 11 of the connecting part 10 is aligned with the fastening hole 34 so that a fastener 70 can engage through the fastening hole 34 and the connecting slot 33 for fastening the cup holder 30.

Figure 7:
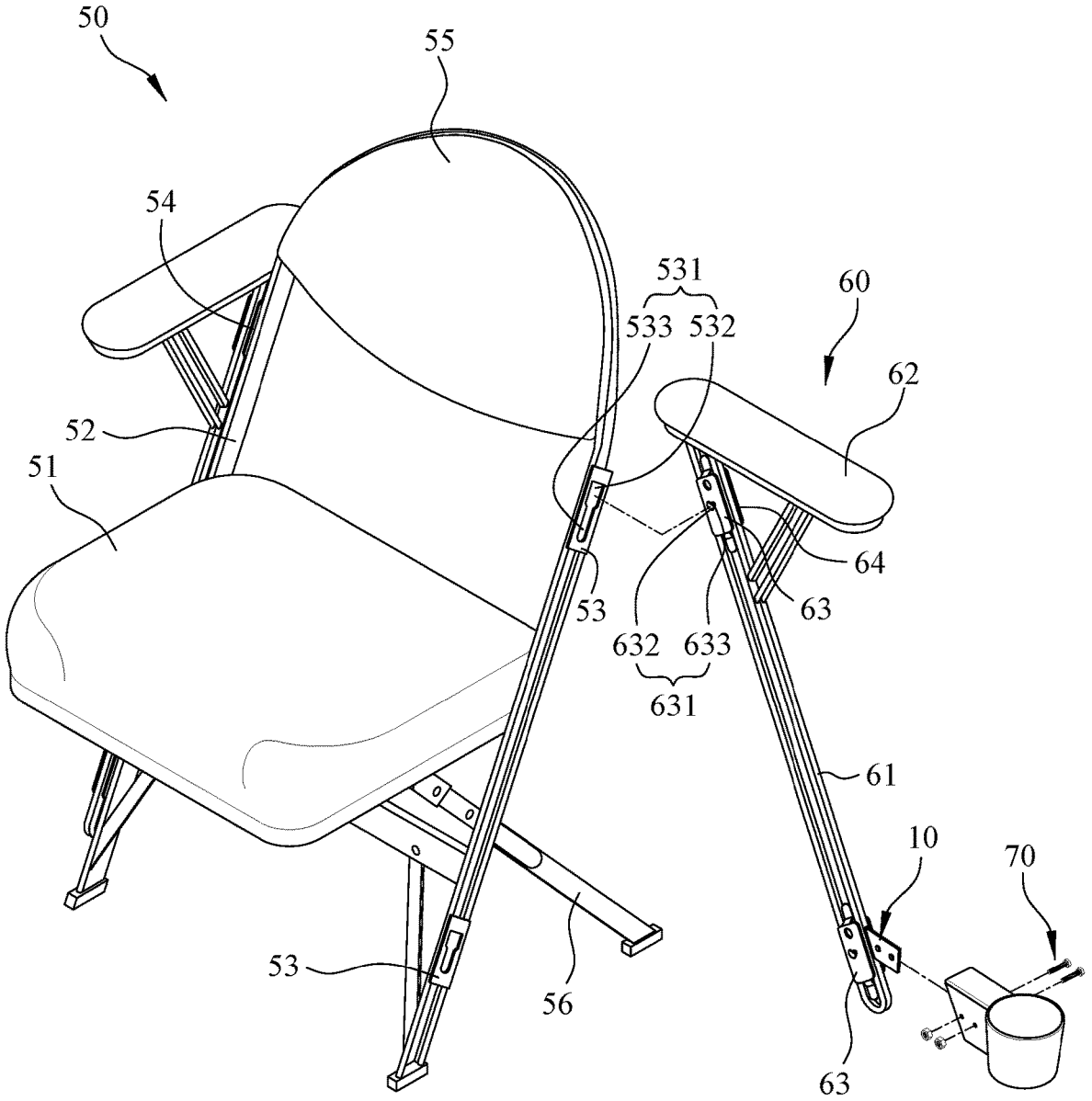
FIG. 7 is a partially exploded view of the cup holding device for a foldable seat according to the first embodiment of the present invention.
Figure 8:
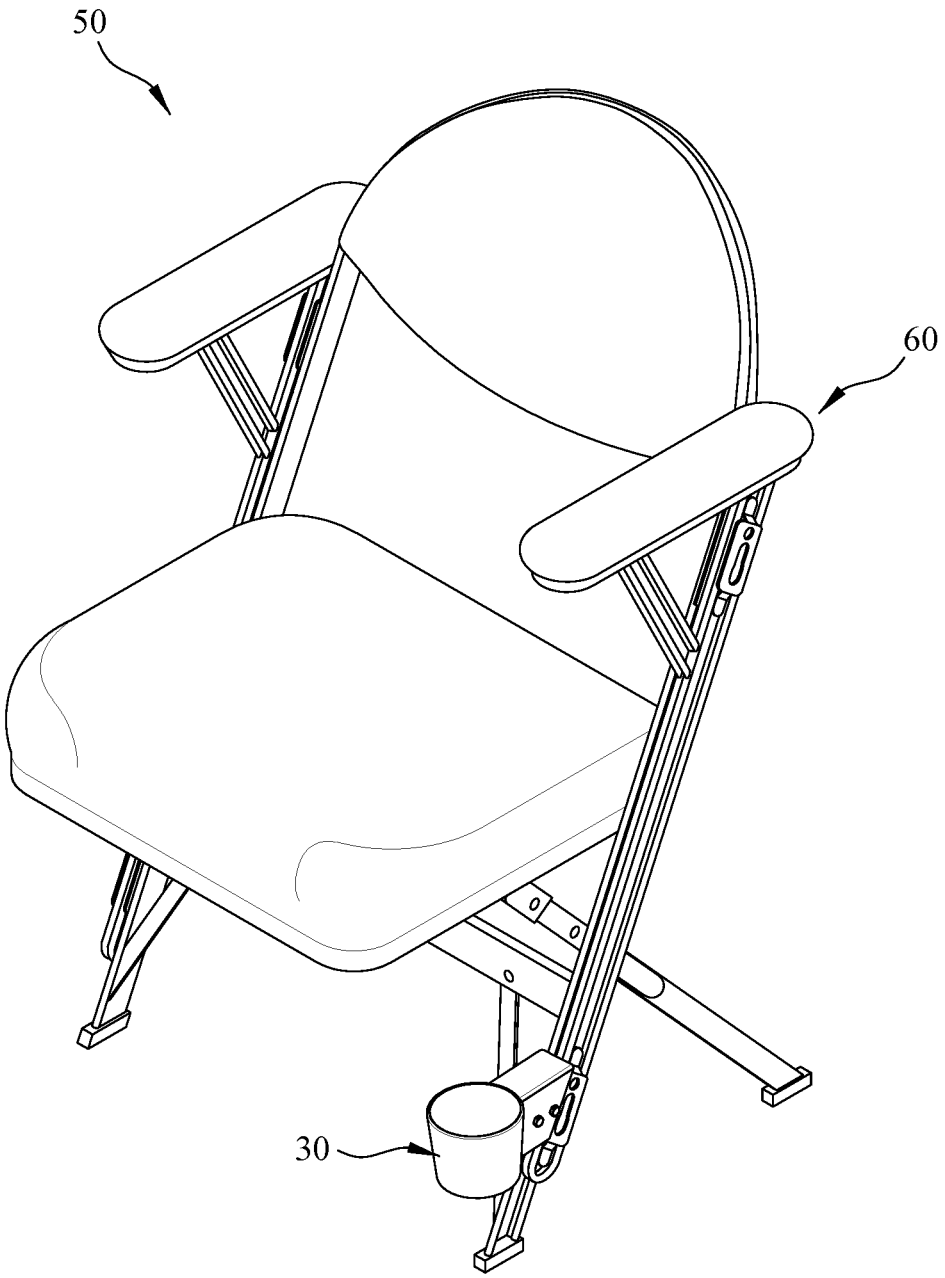
FIG. 8 is a perspective view showing the assembly of the cup holding device for a foldable seat according to the first embodiment of the present invention.

FIGS. 7 and 8 are respectively a partially exploded view and a perspective view showing how the cup holding device is assembled with a foldable seat according to a first embodiment of the present invention. As shown in FIGS. 7 and 8, in the first embodiment of the present invention, the foldable seat 50 includes a front leg frame 52, a backrest 55, a seat portion 51, a rear leg frame 56, at least one first coupling portion 53 and at least one second coupling portion 54. The front leg frame 52 has an arcuate shape, and two inner sides of the front leg frame 52 are respectively connected pivotally to the seat portion 51 and the rear leg frame 56. The backrest 55 is disposed in the region of the arcuate shape of the front leg frame 52. With the front leg frame 52 pivotally connected to the seat portion 51 and the rear leg frame 56, the seat portion 51 and the rear leg frame 56 can be flipped and folded for storage. At least one first coupling portion 53 is provided on the right side of the front leg frame 52, and at least one second coupling portion 54 is provided on the left side of the front leg frame 52.

The armrest frame 60 is provided at one side of the front leg frame 52 in the foldable seat 50. The armrest frame 60 includes a support frame portion 61 and an armrest pad 62. The armrest pad 62 is disposed at a top of the support frame portion 61. The connecting part 10 is disposed at a lower end of the support frame portion 61. Preferably, the connecting part 10 is provided on the armrest frame 60, and is located below the seat portion 51 of the foldable seat 50 when the armrest frame 60 is assembled with a side of the front leg frame 52 of the foldable seat 50.

In a first embodiment of the present invention, the armrest frame 60 further includes at least one first joining portion 63 and at least one second joining portion 64. The first joining portion 63 is provided on one side of the support frame portion 61, and the second joining portion 64 is provided on the other side of the support frame portion 61. The first joining portion 63 is adapted to assemble with the first coupling portion 53 of the foldable seat 50, and the second joining portion 64 is adapted to assemble with the second coupling portion 54 of the foldable seat 50.

More specifically, the first joining portion 63 includes a protrusion 631 having a head 632 and a stem 633, the head 632 being provided at a distal end of the stem 633.

Referring to FIGS. 1 and 2, the second joining portion 64 includes a positioning slot 641 having a large slot opening 642 and a narrow slot opening 643, the large slot opening 642 being provided at one end of the narrow slot opening 643.

In the first embodiment of the present invention, the first coupling portion 53 of the front leg frame 52 matches with the first joining portion 63 in structure, and the second coupling portion 54 of the front leg frame 52 matches with the second joining portion 64 in structure, whereby the first coupling portion 53 can engage and attach with the first joining portion 63 and the second coupling portion 54 can engage and attach with the second joining portion 64.

More specifically, the first coupling portion 53 includes a positioning slot 531 having a large slot opening 532 and a narrow slot opening 533, the large slot opening 532 being provided at one end of the narrow slot opening 533. The head 632 on the protrusion 631 of the first joining portion 63 has an outer diameter that is smaller than an inner diameter of the large slot opening 532 and greater than an inner diameter of the narrow slot opening 533, and the stem 633 has an outer diameter that is smaller than the inner diameter of the narrow slot opening 533, whereby the first joining portion 63 can engage and attach with the first coupling portion 53. In other words, the first coupling portion 53 and the second joining portion 64 have a same structure.

The second coupling portion 54 includes a protrusion (not shown) having a head (not shown) and a stem (not shown), the head being provided at a distal end of the stem. The head on the protrusion of the second coupling portion 54 has an outer diameter that is smaller than an inner diameter of the large slot opening 642 and greater than an inner diameter of the narrow slot opening 643, and the stem has an outer diameter that is smaller than the inner diameter of the narrow slot opening 643. In other words, the second coupling portion 54 and the first joining portion 63 have a same structure.

For assembling two cup holding devices with the foldable seat 50, the head 632 on the protrusion 631 of the first joining portion 63 is inserted into the large slot opening 532 and then is moved toward the narrow slot opening 533. Because the size of the head 632 is greater than the narrow slot opening 533, the protrusion 631 is engaged with and retained in the positioning slot 531. The head on the protrusion of the second coupling portion 54 is inserted into the large slot opening 642 of the second joining portion 64 on the other support frame portion 61 and then is moved toward the narrow slot opening 643. Because the size of the head on the protrusion of the second coupling portion 54 is greater than the narrow slot opening 643, the protrusion is engaged with and retained in the positioning slot 641. Two cup holding devices according to the present invention are thereby mounted on two sides of the foldable seat 50.

In the first embodiment of the present invention, the support frame portion 61 has two first joining portions 63 and two second joining portions 64, which corresponds to the number of the first coupling portions 53 and the number of the second coupling portions 54 provided on the foldable seat 50. However, there is no limitation to the number of the first joining portions 63 and the number of the second joining portions 64 provided on the support frame portion 61. The number of the first joining portions 63 and the number of the second joining portions 64 may be increased or reduced in accordance with the number of the first coupling portions 53 and the number of the second coupling portions 54 provided on the foldable seat 50. In the first embodiment of the present invention, two first joining portions 63 are provided on a same side of the support frame portion 61, and two second joining portions 64 are provided on the other side of the support frame portion 61. However, there is no limitation to the positions of the first and second joining portions 63 and 64. More of the first and second joining portions 63 and 64 may be respectively provided at the two sides of the support frame portion 61 according to the needs.

After the cup holder 30 is mounted on the connecting part 10, at least one fastener 70 is engaged through the fastening hole 34 and the connecting hole 11 for affixing the cup holder 30 to the connecting part 10 of the armrest frame 60. More specifically, in the first embodiment of the present invention, the fastener 70 includes a screw 71 and a nut 72. After the screw 71 passes through the connecting slot 33 and protrudes on the other side of the connecting portion 32, the nut 72 is engaged with the protruding portion of the screw 71 to affix the cup holder 30 to the connecting part 10 of the armrest frame 60.

Preferably, the first embodiment of the present invention has two connecting holes 11 and two fastening holes 34. However, there is no limitation to the number of the connecting holes 11 and fastening holes 34. More of the connecting holes 11 and fastening holes 34 may be provided to strengthen the attachment of the cup holder 30 to the connecting part 10.

Figure 9:
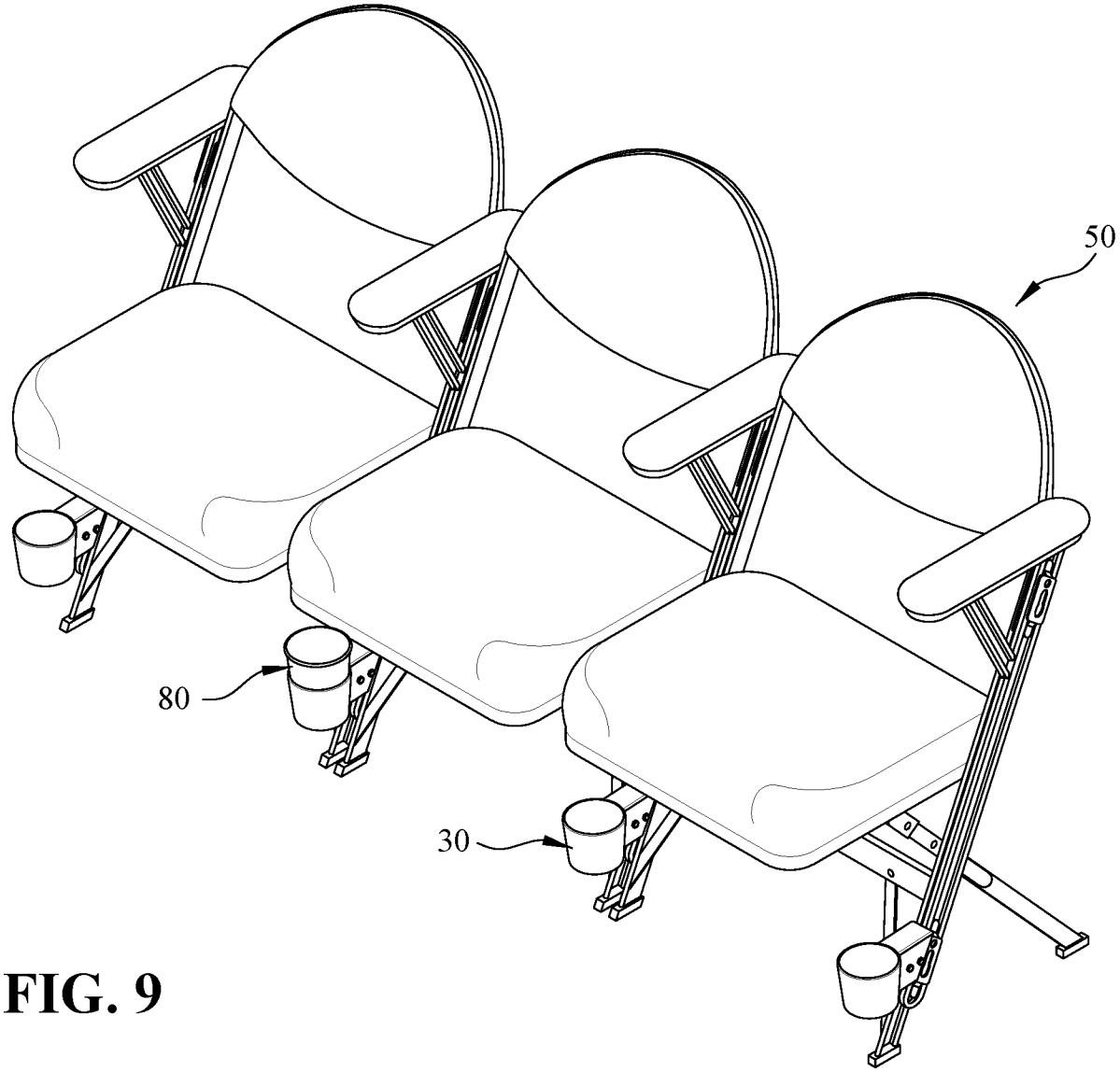
FIG. 9 is a perspective view showing exemplary use of the cup holding device for a foldable seat according to the first embodiment of the present invention.

FIG. 9 is a perspective view showing exemplary use of the cup holding device for a foldable seat according to the first embodiment of the present invention. As shown in FIG. 9, after the cup holder 30 is properly installed, a person sitting on the foldable seat 50 can put the container 80 in the receiving cavity 35. The space at the bottom of the foldable seat 50 can be therefore used for disposing the container 80, which can be conveniently accessed by a person sitting on the foldable seat 50.

Figure 10:
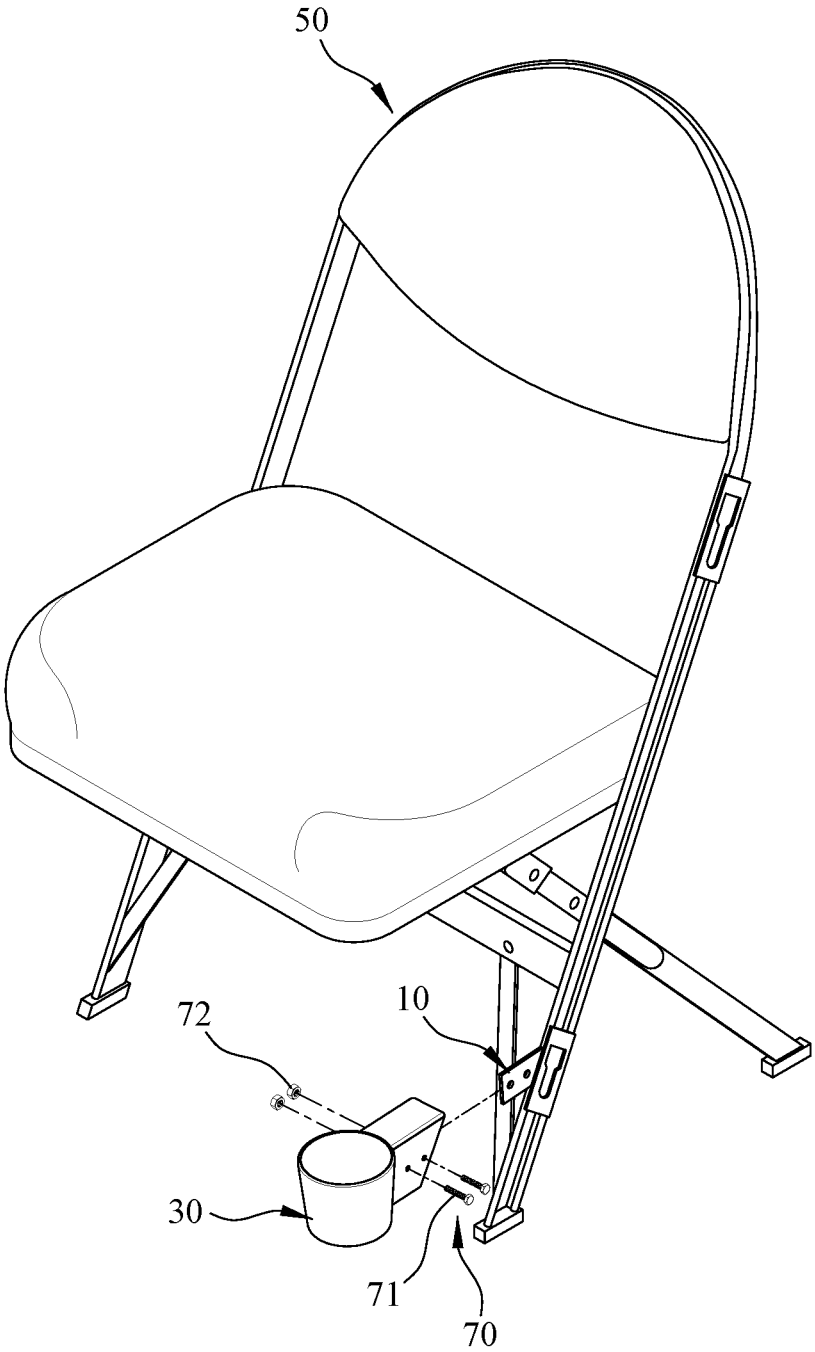
FIG. 10 is an exploded view showing a cup holding device for a foldable seat according to a second embodiment of the present invention.
Figure 11:
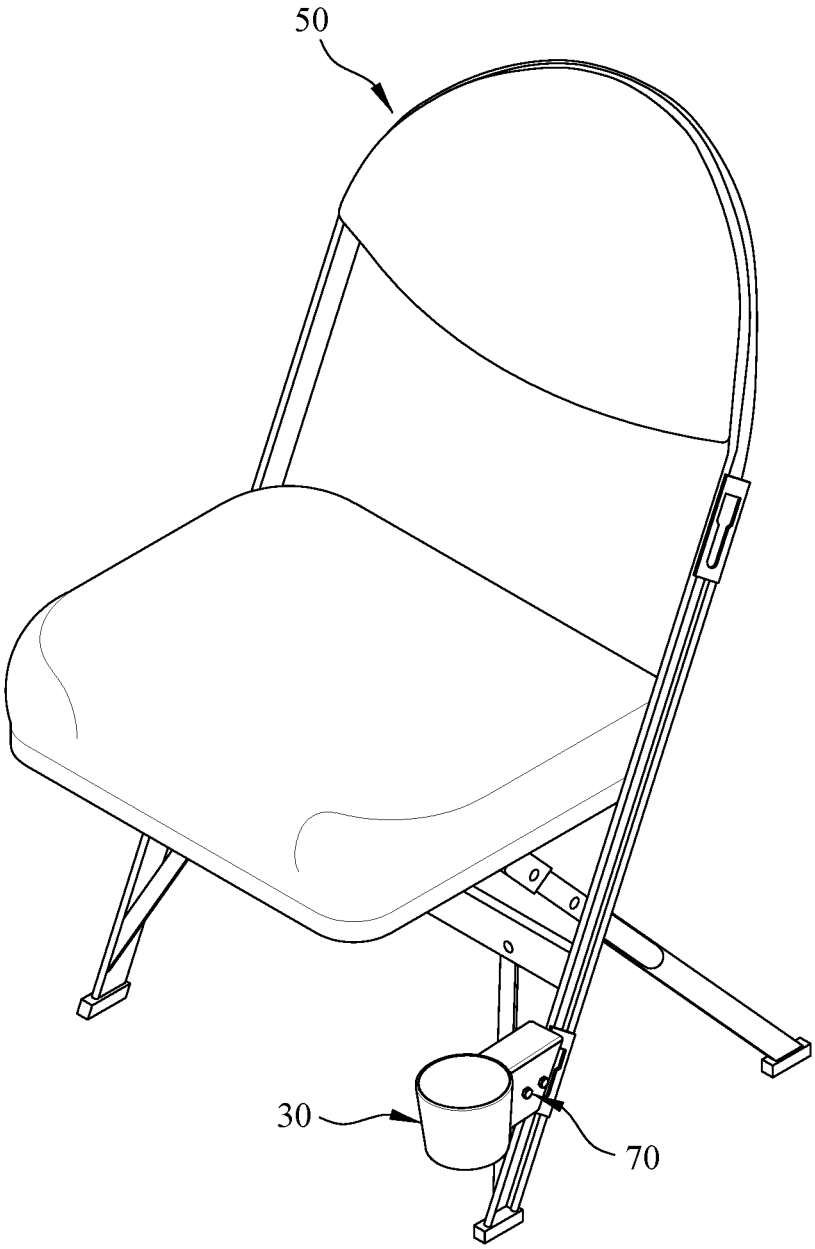
FIG. 11 is a perspective view showing the assembly of the cup holding device for a foldable seat according to the second embodiment of the present invention.

FIGS. 10 and 11 are respectively an exploded view and a perspective view showing a cup holding device for a foldable seat according to a second embodiment of the present invention. As shown in FIGS. 10 and 11, the second embodiment differs from the first embodiment in that the connecting part 10 is provided on the front leg frame 52 of the foldable seat 50 and is located below the seat portion 51 of the foldable seat.

For assembling a cup holding device with the foldable seat 50, the connecting part 10 is inserted into the connecting slot 33, whereby the cup holder 30 is mounted on the connecting part 10. At least one fastener 70 is then engaged through the fastening hole 34 and the connecting hole 11 for affixing the cup holder 30 to the connecting part 10. In use, a person sitting on the foldable seat 50 can put the container 80 in the receiving cavity 35. The space at the bottom of the foldable seat 50 can be therefore used for disposing the container 80, which can be conveniently accessed by a person sitting on the foldable seat 50.

In the second embodiment of the present invention, the first and second coupling portions 53 and 54 have corresponding structures, whereby the first and second coupling portions 53 and 54 can engage and fasten to each other. More specifically, the head on the protrusion of the second coupling portion 54 has an outer diameter that is smaller than an inner diameter of the large slot opening 532 and greater than an inner diameter of the narrow slot opening 533, and the stem has an outer diameter that is smaller than the inner diameter of the narrow slot opening 533, whereby the first coupling portion 53 can engage and attach with the second coupling portion 54.

By placing the connecting part 10 and the cup holder 30 below the seat portion 51 of the foldable seat 50, the present invention can make use of the space at the bottom of the foldable seat 50 and prevent a drinking container from being accidentally hit by a person's swinging arm causing its tipping over.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An armrest frame for a foldable seat with a cup holding device, comprising:

a support frame portion having an armrest pad being disposed at a top thereof, and a connecting part provided at a lower end of the support frame portion and being located below a seat portion of the foldable seat;

at least one first joining portion being provided on one side of the support frame portion being adapted to assemble with a right side of a front leg frame of the foldable seat, wherein the first joining portion includes a protrusion having a head and a stem, the head being provided at a distal end of the stem;

at least one second joining portion being provided on the other side of the support frame portion being adapted to assemble with a left side of the front leg frame of the foldable seat, wherein the second joining portion includes a positioning slot having a large slot opening and a narrow slot opening, the large slot opening being provided at one end of the narrow slot opening; and a cup holder mounted on the connecting part, the cup holder having a receiving cavity adapted to receive a container, wherein the connecting part includes at least one connecting hole, and the cup holder further has a holding portion, a connecting portion, a connecting slot and at least one fastening hole, the holding portion being provided at one end of the connecting portion, the receiving cavity being opened on the holding portion, the connecting slot being provided at the other end of the connecting portion, the fastening hole being provided at a side of the connecting portion, the fastening hole communicating with the connecting slot and extending through the connecting portion, the connecting part being inserted into the connecting slot, and at least one fastener being engaged through the fastening hole and the connecting hole.

2. The armrest frame according to claim 1, wherein a bottom of the holding portion has at least one through-hole communicating with the receiving cavity.

3. The armrest frame according to claim 1, wherein an opening of the connecting slot has a chamfer.

* * * * *